US005158926A

United States Patent [19]

Hotta et al.

[11] Patent Number: 5,158,926

[45] Date of Patent: Oct. 27, 1992

[54] REVERSIBLE THERMOSENSITIVE RECORDING MATERIAL

[75] Inventors: Yoshihiko Hotta, Mishima; Makoto Kawaguchi, Shizuoka; Kunichika Morohoshi, Numazu; Yukio Konagaya, Shimizu; Toru Nogiwa, Numazu; Akira Suzuki, Mishima; Fumihito Masubuchi, Numazu, all of Japan

[73] Assignee: Ricoh Company, Ltd., Tokyo, Japan

[21] Appl. No.: 753,365

[22] Filed: Aug. 30, 1991

[30] Foreign Application Priority Data

| | | | |
|---|---|---|---|
| Aug. 30, 1990 | [JP] | Japan | 2-229581 |
| Nov. 22, 1990 | [JP] | Japan | 2-320234 |
| Dec. 26, 1990 | [JP] | Japan | 2-414434 |
| Aug. 23, 1991 | [JP] | Japan | 3-237294 |

[51] Int. Cl.[5] ..... B41M 5/26; B41M 5/40

[52] U.S. Cl. ..... 503/217; 428/195; 428/913; 503/200; 503/208; 503/209; 503/214; 503/225; 503/226

[58] Field of Search ..... 428/195, 412, 480, 500, 428/522, 913; 503/200, 208, 209, 214, 216, 217, 225, 226

[56] References Cited

U.S. PATENT DOCUMENTS 4,425,161 1/1984 Shibahashi et al. ..... 106/21

*Primary Examiner*—Bruce H. Hess

*Attorney, Agent, or Firm*—Oblon, Spivak, McClelland, Maier & Neustadt

[57] ABSTRACT

A reversible thermosensitive recording material is composed of a support and a reversible thermosensitive recording layer formed on the support. The reversible thermosensitive recording layer includes a matrix resin and an organic low-molecular-weight material dispersed in the matrix resin, and has a temperature-dependent transparency. The matrix resin includes a resin component having a glass transition temperature of 90° C. or more.

14 Claims, 6 Drawing Sheets

REVERSIBLE THERMOSENSITIVE RECORDING MATERIAL

BACKGROUND OF THE INVENTION

1. Field of the Invention

The present invention relates to a reversible thermosensitive recording material capable of recording and erasing images repeatedly by utilizing its property that the transparency can be changed reversibly from a transparent state to an opaque state, and vice versa, depending upon the temperature thereof.

2. Discussion of Background

Recent years, some attention is paid to a reversible thermosensitive recording material capable of temporarily recording images thereon and erasing the same therefrom once such images are regarded as unnecessary. As the representative example of that kind of reversible thermosensitive recording material, there is conventionally known a reversible thermosensitive recording material in which an organic low-molecular-weight material such as a higher fatty acid is dispersed in a matrix resin such as vinyl chloride - vinyl acetate copolymer with a glass transition temperature (Tg) of as low as 50° C. or more to less than 90° C., as disclosed in Japanese Laid-Open Patent Applications 54-119377 and 55-154198.

In the case where only the heat energy is applied to the reversible thermosensitive recording material by using a heat-application roller or a heat-pen, with the pressure hardly applied thereto, in order to perform the recording and erasing operations, the durability of the recording material is not degraded even though the image formation and erasure is repeated. In contrast to this, when the heat and pressure are applied to the recording material at the same time by using a thermal head, the durability of the recording material is degraded during the repeated operations. This is because the matrix resin around the organic low-molecular-weight material particles in the recording layer is deformed and the organic low-molecular-weight material particles finely dispersed in the matrix resin ar gradually accumulated and the particles size thereof thus becomes bigger while the recording and erasing operations are repeated. As a result, the effect of scattering light is decreased, which lowers the whiteness degree of a white opaque portion in the recording layer Finally, the image contrast is disadvantageously lowered.

SUMMARY OF THE INVENTION

An object of the present invention is to provide a reversible thermosensitive recording material free from the above-mentioned conventional defects, having improved durability, with a decrease in the whiteness degree of a milky white opaque portion of the recording material being minimized when the image formation and erasure is repeatedly performed by applying the heat and pressure to the reversible thermosensitive recording material at the same time by using a thermal head.

The above-mentioned object of the present invention can be achieved by a reversible thermosensitive recording material comprising a support and a reversible thermosensitive recording layer, formed thereon, which comprises a matrix resin and an organic low-molecular-weight material dispersed in the matrix resin, with the matrix resin comprising a resin component having a glass transition temperature of 90° C. or more.

BRIEF DESCRIPTION OF THE DRAWINGS

A more complete application of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the reversible thermosensitive recording material of the present invention which comprises a matrix resin and an organic low-molecular-weight material dispersed therein, which transparency is reversibly changeable depending on the temperature thereof, the matrix resin comprises a high-heat-resistant resin component with a glass transition temperature of 90° C. or more.

Therefore, the matrix resin in the recording material is scarcely deformed even when the heat and pressure are applied to the reversible thermosensitive recording material by using a thermal head to perform the recording and erasing operations repeatedly. The organic low-molecular-weight material particles finely dispersed in the matrix resin are not accumulated in the course of the repeated operations, so that the organic low-molecular-weight material can be retained in the form of finely-divided particles and dispersed in the matrix resin. As a result, the whiteness degree of a white opaque portion in the recording material is not decreased, which can achieve the high image contrast.

The reversible thermosensitive recording material of the present invention can be switched from a transparent state to a milky white opaque state, and vice versa, depending on the temperature thereof. It is presumed that the difference between the transparent state and the milky white opaque state of the recording material is based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times on the interface of crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
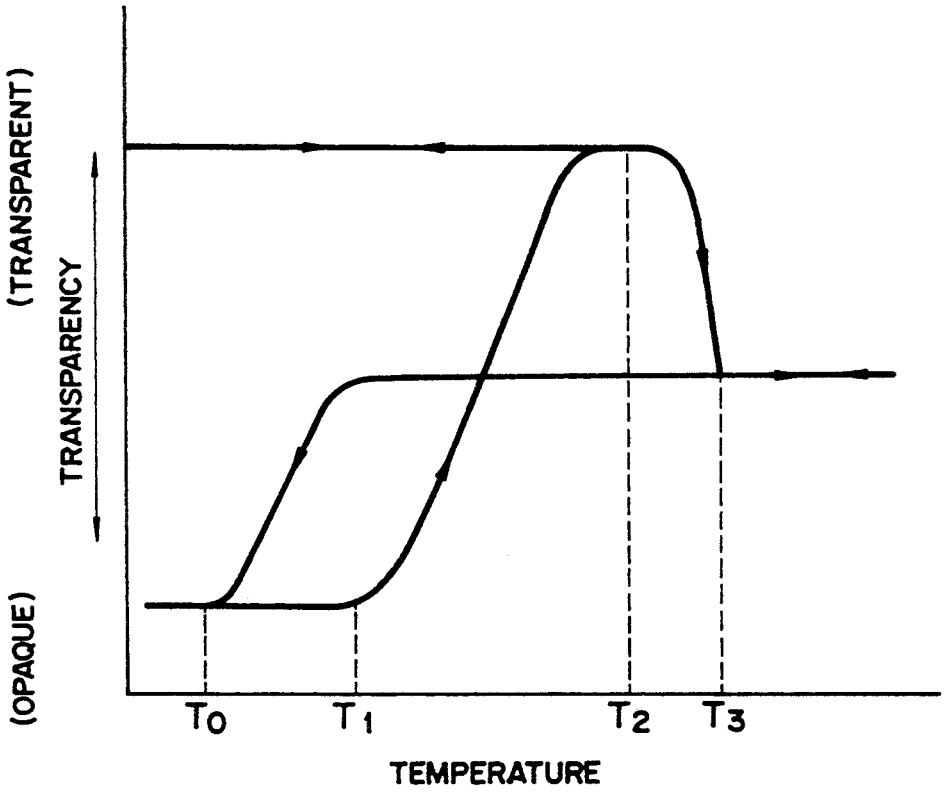
FIG. 1 is a graph in explanation of the principle of formation and erasure of images in a reversible thermosensitive recording material of the present invention.

In FIG. 1, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$ Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to a temperature below the room temperature $T_0$, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

It is preferable that the thickness of the reversible thermosensitive recording layer be in the range of 1 to 30 μm, more preferably in the range of 2 to 20 μm. When the thickness of the reversible thermosensitive layer is within the above range, the portions in the recording layer to which the heat energy is applied can uniformly assume a transparent state because the heat is uniformly distributed, and the whiteness degree of the white opaque portion in the recording layer is not lowered so as to maintain the high image contrast. When the amount of a fatty acid in the thermosensitive recording layer is properly increased, the whiteness degree can also be increased.

To record the image on the reversible thermosensitive recording material of the present invention and erase it therefrom, two thermal heads, one is for the image formation and the other is for the image erasure may be used. Alternatively, a single thermal head is available if the conditions for applying the heat energy to the recording material can be changed depending on the recording operation and the erasing operation.

In the case where two thermal heads are used, a device for applying the heat energy to the recording material is expensive, however, the image formation and erasure can easily be performed by once causing the recording material to pass through the two thermal heads from which the different heat energy is separately applied to the recording material corresponding to the image formation and image erasure. On the other hand, in the case where a single thermal head is used for both image formation and erasure, the cost of the above-mentioned device is low, but the operation becomes complicated. More specifically, it is necessary to delicately change the heat application conditions of the single thermal head corresponding to a portion where an image is to be recorded or erased while the recording material is caused to pass through the single thermal head at one operation. Or the images are erased by applying the thermal energy for image erasure to the recording material while the recording material is first caused to pass through the single thermal head. Then, when the recording material is caused to reversibly pass through the single thermal head, the images are recorded by the application of the thermal energy for image formation to the recording material.

To form the reversible thermosensitive recording layer on the support, (1) a solution in which both the matrix resin and the organic low-molecular-weight material are dissolved, or (2) a dispersion prepared by dispersing the finely-divided particles of the organic low-molecular-weight material in a matrix resin solution may be coated on the support such as a plastic film or a glass plate, then dried, so that the reversible thermosensitive recording layer can be formed on the support. The aforementioned matrix resin dispersion of the low-molecular-weight material (2) employs a solvent in which at least one of the low-molecular-weight materials can not be dissolved.

The solvent used for the formation of the thermosensitive recording layer can be selected depending on the kin of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. When not only the matrix resin dispersion (2), but also the solution (1) is used, the organic low-molecular-weight material in the form of finely-divided particles can be dispersed in the matrix resin in the thermosensitive recording layer.

It is preferable to employ such a matrix resin that can form a reversible thermosensitive recording layer in which finely-divided particles of the organic low-molecular-weight material are uniformly dispersed and that can impart high transparency to the recording layer when the recording layer is in a maximum transparent state. In the present invention, the matrix resin comprises a resin component with a glass transition temperature of 90° C. or more, preferably 100° C. or more, more preferably 110° C. or more. The higher the glass transition temperature of the resin component in the matrix resin, the better the durability of the recording material. In addition to the above, it is preferable that the matrix resin have high transparency, mechanical stability and excellent film-forming properties.

The durability of the reversible thermosensitive recording material according to the present invention is improved because the matrix resin comprises a resin component with a glass transition temperature of 90° C. or more. The reason for this is considered as follows. The transition of the state of the recording material between the transparent state and the milky white opaque state depends on the melting temperature of the organic low-molecular-weight material dispersed in the matrix resin. Usually, the organic low-molecular-weight material with a melting temperature of 50° to 120° C., further preferably 70° to 100° C. from the viewpoints of the thermosensitivity and the image stability, is employed in such a recording material.

Namely, it is necessary to heat the reversible thermosensitive recording material up to the temperature of about 100° to 120° C. in order to reversibly change between the transparent state and the milky white opaque state in the practical use.

Generally, when the resin is heated, the temperature where the resin is mechanically deformed, which depends on the kind of resin, is higher than the glass transition temperature thereof by about 10° to 50° C. Therefore, if the glass transition temperature of a resin is 90° C., the resin is not mechanically deformed up to the temperature of about 100° to 140° C., and when the glass transition temperature of a resin is 110° C., the resin is not deformed up to the temperature of about 120° to 170° C.

Examples of the resin component with a glass transition temperature of 90° C. or more for use in the present invention are as follows (the grass transition temperature of each resin is shown in parenthesis):

chlorinated vinyl chloride resin (95° to 125° C.), phenoxy resin (100° to 110° C.), styrene resin (100° to 140° C.), polymethyl methacrylate (105, 115° C.), polydivinyl benzene (106° C.), polycarbonate (145° to 150° C.), polyvinyl formal (105° C.), a high-heat-resistant polyester (90° to 130° C.), and copolymers of the above resin components. These resins can be used alone or in combination.

Examples of the above-mentioned styrol resin include polystyrene (100° C.: weight-average molecular weight of 20,000 or more), tert-butyl polystyrene (132° C.), p-chloro polystyrene (128° C.), p-methyl polystyrene (106° C.), p-phenoxy polystyrene (100° C.), and dichloro polystyrene (100° C. to 170° C.).

Among the above-mentioned resin components with a glass transition temperature of 90° C. or more, there is the high-heat-resistant polyester. The glass transition temperature of the conventional polyester is lower than 90° C. For example, the glass transition temperature of polyethylene terephthalate (PET), which is one of the well-known polyester resins is 69° C. The above polyethylene terephthalate is generally prepared by the ester interchange reaction between dimethyl terephthalate and ethylene glycol. The conventional polyester is hereinafter referred to as a low-heat-resistant polyester.

On the other hand, the high-heat resistant polyester resin with a glass transition temperature of 90° C. or more for use in the present invention is prepared by allowing an aromatic diol, instead of the glycol, to react with a dicarboxylic acid ester. The heat resistance of the high-heat-resistant polyester for use in the present invention can be improved since the high-heat-resistant polyester has many benzene rings therein.

In the present invention, as previously mentioned, the matrix resin comprises a resin component with a glass transition temperature of 90° C. or more. In addition, the matrix resin may further comprise at least one resin component with a glass transition temperature of less than 90° C. to prevent the whiteness degree of a white opaque portion in the recording material from decreasing while the image formation and erasure is repeatedly performed.

Examples of the resin component with a glass transition temperature of less than 90° C. include vinyl chloride copolymers such as vinyl chloride resin with a glass transition temperature of 75° C. to 85° C., vinyl chloride - vinyl acetate copolymer wtih a glass transition temperature of 50° to 80° C., vinyl chloride - vinyl acetate - vinyl alcohol copolymer with a glass transition temperature of 60° to 80° C. and vinyl chloride - vinyl acetate - maleic acid copolymer with a glass transition temperature of 60° to 80° C.; vinylidene chloride copolymers such as polyvinylidene chloride with a glass transition temperature of 3118° C., vinylidene chloride - vinyl chloride copolymer with a glass transition temperature of 30° C. to 80° C. and vinylidene chloride - acrylonitrile copolymer with a glass transition temperature of 30° C. to 80° C.; and the low-heat-resistant polyester with a glass transition temperature of 60° C. to 85° C.

It is preferable that the ratio by weight of a resin component with a glass transition temperature of 90° C. or more be at least 1 wt.%, more preferably 1 to 80 wt.%, further preferably 3 to 50 wt.% of the total weight of the matrix resin. When the ratio by weight of the resin component with a glass transition temperature of 90° C. or more is within the above range, the durability of the recording material can be improved, and at the same time, the effect of increasing the image contrast can be achieved.

The organic low-molecular-weight material for use in the reversible thermosensitive recording layer may be appropriately selected from the materials which are changeable from the polycrystalline state to the single crystalline state in accordance with each of the desired temperatures ranging from $T_1$ to $T_3$ as shown in FIG. 1. It is preferable that the organic low-molecular-weight material for use in the present invention have a melting point ranging from 30° C. to 200° C., more preferably from about 50° C. to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— and a halogen atom.

Specific example of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid and oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

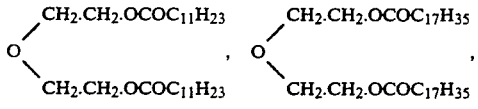

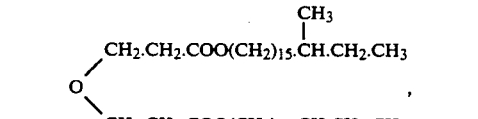

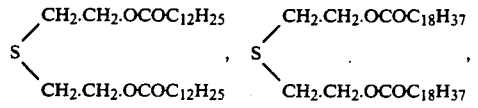

-continued

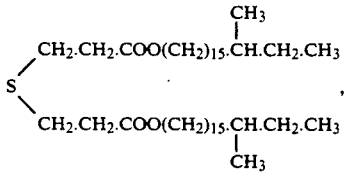

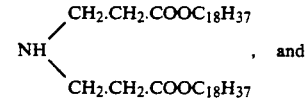

and

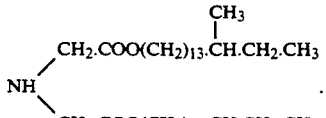

Of these, higher fatty acids having 16 or more carbon atoms more preferably having 16 to 24 carbon atoms, such as palmitic acid, stearic acid, behenic acid and lignoceric acid are preferred in the present invention.

To widen the range of the temperature where the recording material can assume a transparent state, it is preferable to use the aforementioned organic low-molecular-weight materials in combination, or use the organic low-molecular-weight material in combination with the other material having a different melting point. Such materials having a different melting point are disclosed, for example, in Japanese Laid-Open Patent Applications 63-39378 and 63-130380, and Japanese Patent Publications 63-14754 and 1-140109.

It is preferable that the ratio by weight of the organic low-molecular-weight material to the matrix resin be in the range of about (2:1) to (1:16), more preferably in the range of (1:1) to (1:3) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

In the reversible thermosensitive recording layer for use in the present invention, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate - amine-containing monomer copolymer; styrene - maleic anhydride copolymer; and olefin - maleic anhydride copolymer.

In the present invention, when the image formed on the reversible thermosensitive recording material is observed as a reflection type image, a light reflection layer may be formed behind the recording layer to improve the contrast of the image even if the thickness of the recording layer is made thin. Specifically, the light reflection layer can be prepared by deposition of aluminum, nickel and tin on the support as disclosed in Japanese Laid-Open Patent Application 64-14079.

Further, an overcoat layer (a protective layer) can be formed on the reversible thermosensitive recording layer in order to protect the thermosensitive recording layer. As the material for the overcoat layer, a silicone rubber and a silicone resin as disclosed in Japanese Laid-Open Patent Application 63-221087, a polysiloxane graft polymer as in Japanese Patent Publication 62-152550, an ultraviolet-curing resin or an electron radiation curing resin as in Japanese Patent Publication 63-310600 can be employed. In any case, the material for the overcoat layer is dissolved in a solvent to prepare a coating liquid and the thus prepared coating liquid is coated on the thermosensitive recording layer. It is desirable that the resin and the organic low-molecular-weight material for use in the thermosensitive recording layer be not easily dissolved in such a solvent for use in the overcoat layer.

Examples of the above-mentioned solvent in which the resin and the organic low-molecular-weight material for use in the thermosensitive recording layer are not easily dissolved include n-hexane, methyl alcohol, ethyl alcohol and isopropyl alcohol. In particular, the alcohol-based solvents are preferred from the viewpoint of the cost.

It is preferable that the thickness of the overcoat layer be 0.1 to 10 μm.

Further, in the case where the light reflection layer is formed on the support, for example, by deposition of aluminum on the support, it is preferable to form an adhesive layer between the light reflection layer and the thermosensitive recording layer to improve the adhesive strength therebetween. Any materials which have good adhesion to both the light reflection layer and the thermosensitive recording layer may be used for the adhesive layer. It is preferable that the material for the adhesive layer comprise a resin as a main component The thickness of the adhesive layer is preferably about 0.01 to 5 μm.

Furthermore, as disclosed in Japanese Laid-Open Patent Application 1-133781, an intermediate layer may be interposed between the overcoat layer and the thermosensitive recording layer to protect the thermosensitive recording layer from a solvent and a monomer component for use in the overcoat layer. As the material for the intermediate layer, besides the above-mentioned resins for use in the thermosensitive recording layer, the thermosetting resins and thermoplastic resins such as polyethylene, polypropylene, polystyrene, polyvinyl alcohol, polyvinyl butyral, polyurethane, saturated polyester, unsaturated polyester, epoxy resin, phenolic resin, polycarbonate and polyamide can be employed. The thickness of the intermediate layer is preferably about 0.1 to 2 μm.

Other features of this invention will become apparent in the course of the following description of exemplary embodiments which are given for illustration of the invention and are not intended to be limiting thereof.

EXAMPLE 1

| | Parts by Weight |
|---|---|
| Stearic acid | 6 |
| Eicosanedioic acid | 4 |
| Diallyl phthalate | 3 |
| Polyester resin (Tg: 108° C., Trademark "ST1570R" made by Toyobo Co., Ltd.) | 25 |
| Tetrahydrofuran | 150 |
| Toluene | 15 |

The above components were mixed to prepare a coating liquid. The thus prepared coating liquid was coated on a transparent polyethylene terephthalate film (PET film) having a thickness of about 100 μm, serving as a support, by a wire bar and dried under application of neat thereto, to prepare a reversible thermosensitive recording layer with a thickness of 15 μm. Thus, a reversible thermosensitive recording material according to the present invention was obtained.

EXAMPLE 2

The procedure for preparation of the reversible thermosensitive recording material in Example 1 was repeated except that the polyester resin "$ST_{1570}R$" (Trademark) used in Example 1 was replaced by a commercially available polyester resin with a glass transition temperature of 90° C., Trademark "$ST_{1610}V$" made by Toyobo Co., Ltd, whereby a reversible thermosensitive recording material according to the present invention was obtained.

COMPARATIVE EXAMPLE 1

The procedure for preparation of the reversible thermosensitive recording material in Example 1 was repeated except that the polyester resin "$ST_{1570}R$" (Trademark) used in Example 1 was replaced by a commercially available vinyl chloride - vinyl acetate copolymer with a glass transition temperature of 72° C., Trademark "VYHH" made by Union Carbide Japan K.K., whereby a comparative reversible thermosensitive recording material was obtained.

COMPARATIVE EXAMPLE 2

The procedure for preparation of the reversible thermosensitive recording material in Example 1 was repeated except that the polyester resin "$ST_{1570}R$" (Trademark) used in Example 1 was replaced by a commercially available polyester resin with a glass transition temperature of 67° C., Trademark "Vylon 200" made by Toyobo Co., Ltd., whereby a comparative reversible thermosensitive recording material was obtained.

COMPARATIVE EXAMPLE 3

The procedure for preparation of the reversible thermosensitive recording material in Example 1 was repeated except that the polyester resin "$ST_{1570}R$" (Trademark) used in Example 1 was replaced by a commercially available vinyl chloride - vinyl acetate - phosphoric ester copolymer with a glass transition temperature of 78° C., Trademark "Denka Vinyl #1000P" made by Denki Kagaku Kogyo K.K., whereby a comparative reversible thermosensitive recording material was obtained.

Figure 2:
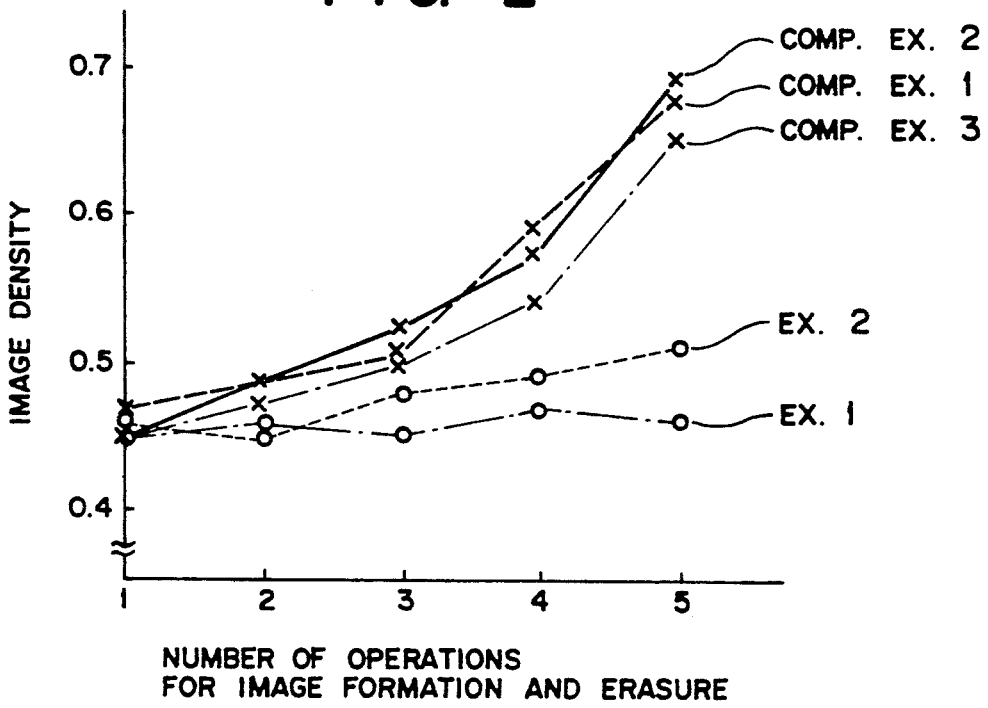
FIG. 2 and FIG. 3 are graphs which show the relationship between the number of the operations for image formation and erasure and the image density of the obtained white opaque image in the reversible thermosensitive recording materials prepared in Examples 1 to 7 and Comparative Examples 1 to 4.

Using a thermal head with a density of 8 dots/mm, the thermal energy was applied to each of the above-prepared reversible thermosensitive recording materials to perform a recording operation under the conditions that the applied electrical power was 1 W and the applied pulse width was 0.7 msec, so that milky white opaque images were obtained against a transparent background. Then, the thus obtained milky white images were erased by being brought into contact with a heat-application roller with a temperature of 80 to 85° C. and a speed of 10 mm/min. The image formation and erasure was repeated five times in the same manner as in the above. When a black drawing paper with a reflection density of 2.0 was placed behind the reversible thermosensitive recording material, the reflection image density of the milky white opaque image was measured each time by Macbeth reflection-type densitometer RD-514. The results are shown in FIG. 2.

EXAMPLE 3

Formation of Light Reflection Layer

An aluminum-deposited layer with a thickness of about 400 Å serving as a light reflection layer was formed on a polyester film with a thickness of about 50 μm.

Formation of Reversible Thermosensitive Recording Layer

The following components were mixed to prepare a coating liquid. The thus obtained coating liquid was coated on the above formed light reflection layer by a wire bar and dried under application of heat thereto, so that a reversible thermosensitive recording layer having a thickness of about 8 μm was formed on the light reflection layer. Thus, a reversible thermosensitive recording material according to the present invention was obtained.

| | Parts by Weight |
|---|---|
| Stearic acid | 24 |
| Eicosanedioic acid | 16 |
| Diisodecyl phthalate | 12 |
| Vinyl chloride-vinyl acetate-phosphoric ester copolymer (Trademark "Denka Vinyl #1000P" made by Denki Kagaku Kogyo K.K., Tg: 78° C.) | 97 |
| Acrylic resin (Trademark "BR85" made by Mitsubishi Rayon Engineering Co., Ltd., Tg: 105° C.) | 3 |
| Tetrahydrofuran | 600 |
| Toluene | 60 |

Formation of Intermediate Layer

The following components were mixed to prepare a coating liquid. The thus obtained coating liquid was coated on the above formed reversible thermosensitive recording layer by a wire bar and dried under application of heat thereto, so that an intermediate layer with a thickness of about 0.5 μm was formed on the reversible thermosensitive recording layer.

| | Parts by Weight |
|---|---|
| Polyamide resin (Trademark "CM8000" made by Toray Industries, Inc.) | 10 |
| Ethyl alcohol | 90 |

Formation of Overcoat Layer

The following components were mixed to prepare a coating liquid. The thus obtained coating liquid was coated on the above formed intermediate layer by a wire bar, dried under application of heat thereto and cured using an ultraviolet lamp of 80 W/cm, so that an overcoat layer with a thickness of about 2 μm was formed.

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

Thus, a reversible thermosensitive recording material according to the present invention was obtained.

EXAMPLE 4

The procedure for preparation of the reversible thermosensitive recording material in Example 3 was repeated except that the formulation of the reversible thermosensitive recording layer used in Example 3 was changed as follows:

| | Parts by Weight |
|---|---|
| Stearic acid | 24 |
| Eicosanedioic acid | 16 |
| Diisodecyl phthalate | 12 |
| Vinyl chloride-vinyl acetate-phosphoric ester copolymer (Trademark "Denka Vinyl #1000P" made by Denki Kagaku Kogyo K.K., Tg: 78° C.) | 80 |
| Acrylic resin (Trademark "BR85" made by Mitsubishi Rayon Engineering Co., Ltd., Tg: 105° C.) | 20 |
| Tetrahydrofuran | 600 |
| Toluene | 60 |

Thus, a reversible thermosensitive recording material according to the present invention was obtained.

EXAMPLE 5

The procedure for preparation of the reversible thermosensitive recording material in Example 3 was repeated except that the formulation of the reversible thermosensitive recording layer used in Example 3 was changed as follows:

| | Parts by Weight |
|---|---|
| Stearic acid | 24 |
| Eicosanedioic acid | 16 |
| Diisodecyl phthalate | 12 |
| Vinyl chloride-vinyl acetate-phosphoric ester copolymer (Trademark "Denka Vinyl #1000P" made by Denki Kagaku Kogyo K.K., Tg: 78° C.) | 30 |
| Acrylic resin (Trademark "BR85" made by Mitsubishi Rayon Engineering Co., Ltd., Tg: 105° C.) | 70 |
| Tetrahydrofuran | 600 |
| Toluene | 60 |

Thus, a reversible thermosensitive recording material according to the present invention was obtained.

EXAMPLE 6

The procedure for preparation of the reversible thermosensitive recording material in Example 3 was repeated except that the formulation of the reversible thermosensitive recording layer used in Example 3 was changed as follows:

| | Parts by Weight |
|---|---|
| Behenic acid | 24 |
| Eicosanedioic acid | 16 |
| Diallyl phthalate | 12 |
| Vinyl chloride-vinyl acetate copolymer (Trademark "VYHH" made by Union Carbide Japan K.K., Tg: 72° C.) | 80 |
| Acrylic resin (Trademark "BR75" made by Mitsubishi Rayon Engineering Co., Ltd., Tg: 90° C.) | 20 |
| Tetrahydrofuran | 600 |
| Toluene | 60 |

Thus, a reversible thermosensitive recording material according to the present invention was obtained.

EXAMPLE 7

The procedure for preparation of the reversible thermosensitive recording material in Example 3 was repeated except that the formulation of the reversible thermosensitive recording layer used in Example 3 was changed as follows:

| | Parts by Weight |
|---|---|
| Stearic acid | 24 |
| Eicosanedioic acid | 16 |
| Diisodecyl phthalate | 12 |
| Polyester resin (Trademark "Vylon 200" made by Toyobo Co., Ltd., Tg: 67° C.) | 80 |
| Acrylic resin (Trademark "BR75" made by Mitsubishi Rayon Engineering Co., Ltd., Tg: 90° C.) | 20 |
| Tetrahydrofuran | 600 |
| Toluene | 60 |

Thus, a reversible thermosensitive recording material according to the present invention was obtained.

COMPARATIVE EXAMPLE 4

The procedure for preparation of the reversible thermosensitive recording material in Example 3 was repeated except that the formulation of the reversible thermosensitive recording layer used in Example 3 was changed as follows:

| | Parts by Weight |
|---|---|
| Stearic acid | 24 |
| Eicosanedioic acid | 16 |
| Diisodecyl phthalate | 12 |
| Vinyl chloride-vinyl acetate-phosphoric ester copolymer (Trademark "Denka Vinyl #1000P" made by Denki Kagaku Kogyo K.K., Tg: 78° C.) | 100 |
| Tetrahydrofuran | 600 |
| Toluene | 60 |

Thus, a comparative reversible thermosensitive recording material was obtained.

Using each of the above reversible thermosensitive recording materials according to the present invention prepared in Examples 3 to 7 and the comparative reversible thermosensitive recording material in Comparative Example 4, image formation and erasure was repeated five times in the same manner as in Example 2.

Figure 3:
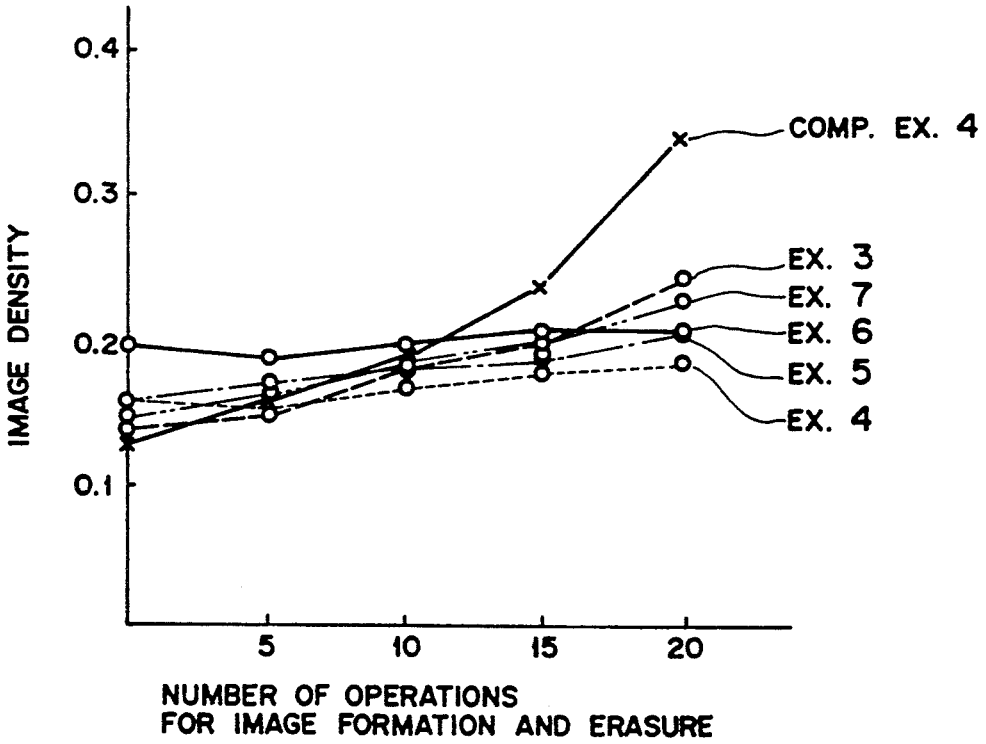

The reflection image density of the milky white opaque image was measured each time by Macbeth reflection-type densitometer RD-541 without placing a black drawing paper behind the reversible thermosensitive recording material. The results are shown in FIG. 3.

EXAMPLE 8

Formation of Light Reflection Layer

An aluminum-deposited layer with a thickness of about 40 nm serving as a light reflection layer was formed on a polyester film with a thickness of about 50 μm.

Formation of Reversible Thermosensitive Recording Layer

The following components were mixed to prepare a coating liquid. The thus obtained coating liquid was coated on the above formed light reflection layer by a wire bar and dried under application of heat thereto, so that a reversible thermosensitive recording layer having a thickness of about 5 μm was formed on the light reflection layer.

| | Parts by Weight |
|---|---|
| Behenic acid | 9 |
| Eicosanedioic acid | 1 |
| Chlorinated vinyl chloride resin (Trademark "ES941F" made by Sekisui Chemical Co., Ltd., Tg: 95° C.) | 30 |
| Di-2-ethylhexyl phthalate | 3 |
| Tetrahydrofuran | 150 |
| Toluene | 15 |

Formation of Intermediate Layer

The following components were mixed to prepare a coating liquid for an intermediate layer. The thus obtained coating liquid was coated on the above formed reversible thermosensitive recording layer by a wire bar and dried under application of heat thereto, so that an intermediate layer having a thickness of about 0.5 μm was formed on the reversible thermosensitive recording layer.

| | Parts by Weight |
|---|---|
| Polyamide resin (Trademark "CM 8000" made by Toray Industries, Inc.) | 10 |
| Ethyl alcohol | 90 |

Formation of Overcoat Layer

The following components were mixed to prepare a coating liquid for an overcoat layer. The thus obtained coating liquid was coated on the above formed intermediate layer by a wire bar, dried under application of heat thereto and hardened by using an ultraviolet lamp of 80 W/cm, so that an overcoat layer having a thickness of about 2 μm was formed on the intermediate layer.

Thus, a reversible thermosensitive recording material according to the present invention was obtained.

EXAMPLE 9

The procedure for preparation of the reversible thermosensitive recording material in Example 8 was repeated except that the formulation of the reversible thermosensitive recording layer used in Example 8 was changed as follows:

| | Parts by Weight |
|---|---|
| Behenic acid | 9 |
| Eicosanedioic acid | 1 |
| Chlorinated vinyl chloride resin (Trademark "ES941F" made by Sekisui Chemical Co., Ltd., Tg: 95° C.) | 15 |
| Chlorinated vinyl chloride resin (Trademark "ES941N" made by Sekisui Chemical Co., Ltd., Tg: 120° C.) | 10 |
| Di-2-ethylhexyl phthalate | 3 |
| Tetrahydrofuran | 150 |
| Toluene | 15 |

Thus, a reversible thermosensitive recording material according to the present invention was obtained.

EXAMPLE 10

The procedure for preparation of the reversible thermosensitive recording material in Example 8 was repeated except that the formulation of the reversible thermosensitive recording layer used in Example 8 was changed as follows:

| | Parts by Weight |
|---|---|
| Behenic acid | 9 |
| Eicosanedioic acid | 1 |
| Vinyl chloride-vinyl acetate copolymer (Trademark "VYHH" made by Union Carbide Japan K.K., Tg: 72° C.) | 20 |
| Chlorinated vinyl chloride resin (Trademark "ES941F" made by Sekisui Chemical Co., Ltd., Tg: 95° C.) | 10 |
| Di-2-ethylhexyl phthalate | 3 |
| Tetrahydrofuran | 150 |
| Toluene | 15 |

Thus, a reversible thermosensitive recording material according to the present invention was obtained.

COMPARATIVE EXAMPLE 5

Formation of Light Reflection Layer

An aluminum-deposited layer with a thickness of about 40 nm serving as a light reflection layer was formed on a polyester film with a thickness of about 50 μm.

Formation of Reversible Thermosensitive Layer

The following components were mixed to prepare a coating liquid for a reversible thermosensitive recording layer. The thus prepared coating liquid was coated on the above formed light reflection layer by a wire bar, and dried under application of heat thereto, so that a reversible thermosensitive recording layer having a thickness of about 5 μm was formed on the light reflection layer.

| | Parts by Weight |
|---|---|
| Behenic acid | 9 |
| Eicosanedioic acid | 1 |
| Vinyl chloride-vinyl acetate copolymer (Trademark "VYHH" made by Union Carbide Japan K.K., Tg: 72° C.) | 30 |
| Di-2-ethylhexyl phthalate | 3 |
| Tetrahydrofuran | 150 |
| Toluene | 15 |

Formation of Intermediate Layer

The following components were mixed to prepare a coating liquid. The thus obtained coating liquid was coated on the above formed reversible thermosensitive recording layer by a wire bar and dried under application of heat thereto, so that an intermediate layer with a thickness of about 0.5 μm was formed on the reversible thermosensitive recording layer.

| | Parts by Weight |
|---|---|
| Polyamide resin (Trademark "CM8000" made by Toray Industries, Inc.) | 10 |
| Ethyl alcohol | 90 |

Formation of Overcoat Layer

The following components were mixed to prepare a coating liquid. The thus obtained coating liquid was coated on the above formed intermediate layer by a wire bar, dried under application of heat thereto and cured using an ultraviolet lamp of 80 W/cm, so that an overcoat layer with a thickness of about 2 μm was formed.

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

Thus, a comparative reversible thermosensitive recording material was obtained.

Using the above reversible thermosensitive recording materials according to the present invention prepared in Examples 8 to 10 and comparative reversible thermosensitive recording material prepared in Comparative Example 5, image formation and erasure was repeated ten times in the same manner as in Example 2.

Thereafter, the reflection image density of the milky white opaque image and that of the transparent background were measured by Macbeth reflection-type densitometer RD-514 each time the image formation and erasure was performed, once, three times, five times and ten times without placing a black drawing paper behind the recording material.

The results in Examples 8 to 10 and Comparative Example 5 are shown in FIGS. 4 to 7, respectively.

Figure 7:
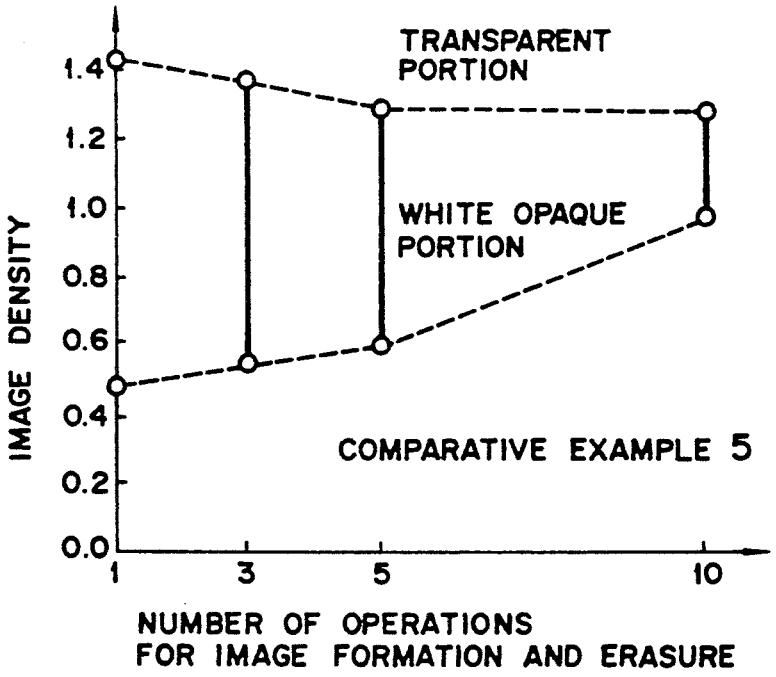

As can be seen from the graph in FIG. 7, the image area hardly became opaque after the image formation and erasure was repeated ten times.

Figure 4:
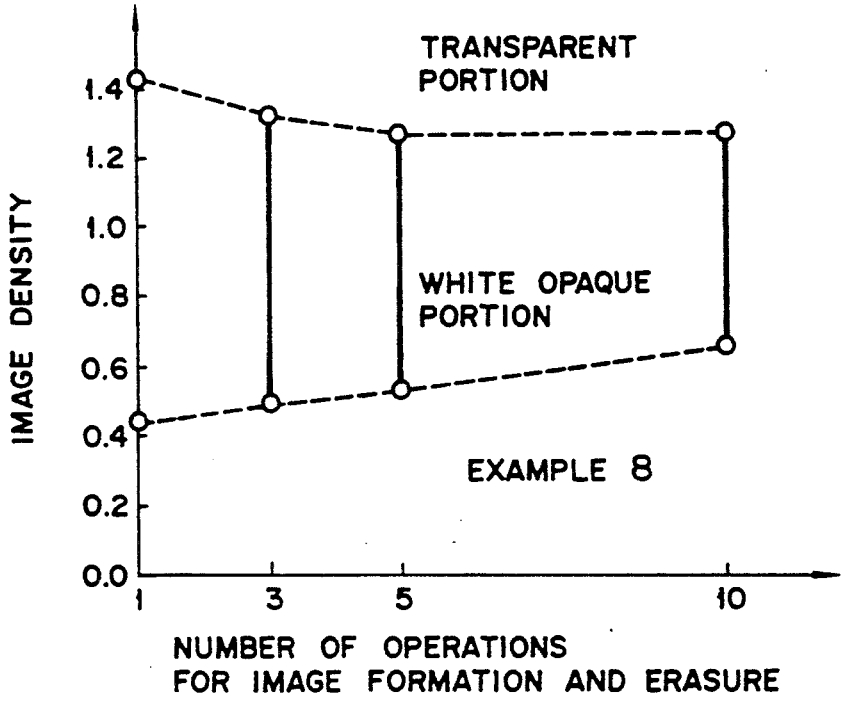
FIGS. 4 to 7 are graphs which show the relationship between the number of the operations for image formation and erasure and the density of a transparent portion and a white opaque portion in the reversible thermosensitive recording materials prepared in Examples 8 to 10 and Comparative Example 5.
Figure 5:
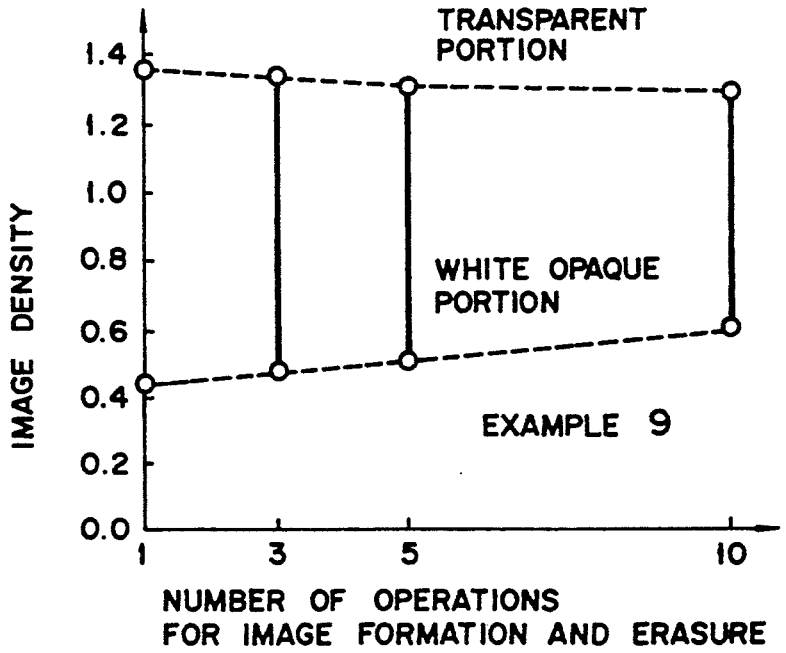
Figure 6:
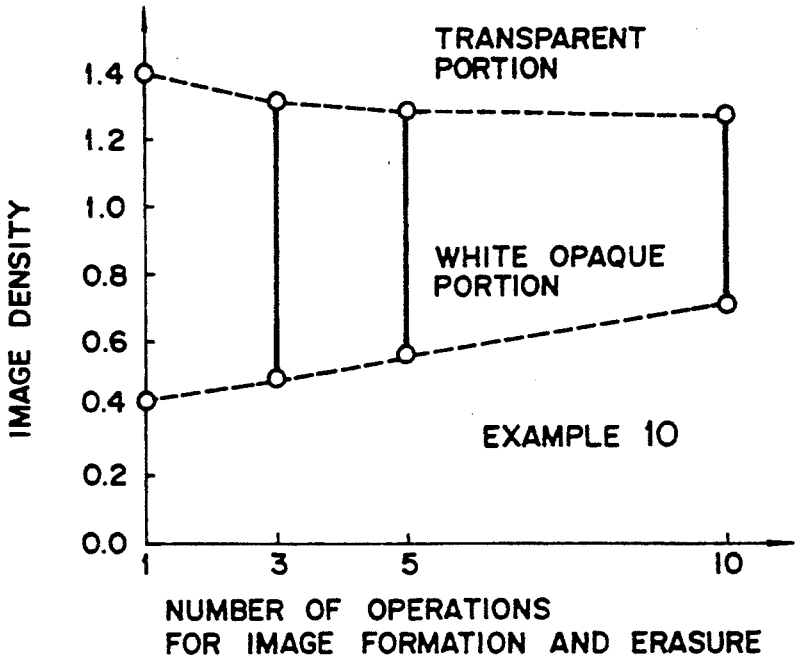

In contrast to the above, as in FIGS. 4 to 6, the density of the milky white opaque image was maintained to be low and that of the transparent background was maintained to be high, so that the image contrast was excellent after the repetition of the image formation and erasure.

EXAMPLE 11

Formation of Light Reflection Layer

An aluminum-deposited layer with a thickness of about 400 nm serving as a light reflection layer was formed on a polyester film with a thickness of about 50 μm.

Formation of Adhesive Layer

The following components were mixed to prepare a coating liquid for an adhesive layer. The thus obtained coating liquid was coated on the above formed light reflection layer by a wire bar and dried under application of heat thereto, so that an adhesive layer having a thickness of about 0.5 μm was obtained.

| | Parts by Weight |
|---|---|
| Vinyl chloride-vinyl acetate-phosphoric ester copolymer (Trademark "Denka Vinyl #1000P" made by Denki Kagaku Kogyo K.K.) | 20 |
| Methyl ethyl ketone | 80 |

Formation of Reversible Thermosensitive Recording Layer

The following components were mixed to prepare a coating liquid for a reversible thermosensitive recording layer. The thus prepared coating liquid was coated on the above formed adhesive layer by a wire bar, and dried under application of heat thereto, so that a reversible thermosensitive recording layer having a thickness of about 5 μm was formed on the adhesive layer.

| | Parts by Weight |
|---|---|
| Behenic acid | 9 |
| Eicosanedioic acid | 1 |
| Chlorinated vinyl chloride resin (Trademark "ES941F" made by Sekisui Chemical Co., Ltd., Tg: 95° C.) | 15 |
| Chlorinated vinyl chloride resin (Trademark "ES941N" made by Sekisui Chemical Co., Ltd., Tg: 120° C.) | 10 |
| Di-2-ethylhexyl phthalate | 3 |
| Tetrahydrofuran | 150 |
| Toluene | 15 |

Formation of Overcoat Layer

The following components were mixed to prepare a coating liquid for an overcoat layer. The thus obtained coating liquid was coated on the above formed reversible thermosensitive recording layer by a wire bar and dried under application of heat thereto and hardened using an ultraviolet lamp of 80 W/cm, so that an overcoat layer with a thickness of about 2 μm was formed on the reversible thermosensitive recording layer.

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

Thus, a reversible thermosensitive recording material according to the present invention was obtained.

The surface of each of the thus formed reversible thermosensitive recording materials in Examples 9 and 11 was cut in the lattice pattern by a cutter knife. An adhesive cellophane tape (made by Nichiban Co., Ltd) was caused to adhere to the surface of the recording material and peeled therefrom to evaluate the adhesive strength of the reversible thermosensitive recording layer to the light reflection layer.

As a result, the recording layer of the recording material in Example 9 was peeled off from the light reflection layer, however, the recording layer of the recording material in Example 11 was not peeled off because the adhesive layer was interposed between the light reflection layer and the recording layer.

EXAMPLE 12

An aluminum-deposited layer with a thickness of about 400 Å serving as a light reflection layer was formed on a polyester film with a thickness of about 50 μm.

The following components were mixed to prepare a coating liquid for a reversible thermosensitive recording layer. The thus obtained coating liquid was coated on the above formed light reflection layer by a wire bar and dried under application of heat thereto, so that a reversible thermosensitive recording layer having a thickness of about 5 μm was formed on the light reflection layer.

| | Parts by Weight |
|---|---|
| Behenic acid | 9 |
| Eicosanedioic acid | 1 |
| Phenoxy resin (Trademark "PKHH" made by Union | 30 |

-continued

| | Parts by Weight |
|---|---|
| Carbide Japan K.K. Tg: 100° C.) | |
| Di-2-ethylhexyl phthalate | 3 |
| Tetrahydrofuran | 150 |
| Toluene | 15 |

Thus, a reversible thermosensitive recording material according to the present invention was obtained.

EXAMPLE 13

The procedure for preparation of the reversible thermosensitive recording material in Example 12 was repeated except that the formulation of the reversible thermosensitive recording layer used in Example 12 was changed as follows:

| | Parts by Weight |
|---|---|
| Behenic acid | 9 |
| Eicosanedioic acid | 1 |
| Phenoxy resin (Trademark "PKHH" made by Union Carbide Japan K.K., Tg: 100° C.) | 5 |
| Vinyl chloride-vinyl acetate copolymer (Trademark "VYHH" made by Union Carbide Japan K.K., Tg: 72° C.) | 25 |
| Di-2-ethylhexyl phthalate | 3 |
| Tetrahydrofuran | 150 |
| Toluene | 15 |

Thus, a reversible thermosensitive recording material according to the present invention was obtained.

EXAMPLE 14

The procedure for preparation of the reversible thermosensitive recording material in Example 12 was repeated except that the formulation of the reversible thermosensitive recording layer used in Example 12 was changed as follows:

| | Parts by Weight |
|---|---|
| Behenic acid | 9 |
| Eicosanedioic acid | 1 |
| Polystyrene resin (Tg: 100° C.) | 5 |
| Vinyl chloride-vinyl acetate copolymer (Trademark "VYHH" made by Union Carbide Japan K.K., Tg: 72° C.) | 25 |
| Di-2-ethylhexyl phthalate | 3 |
| Tetrahydrofuran | 150 |
| Toluene | 15 |

Thus, a reversible thermosensitive recording material according to the present invention was obtained.

COMPARATIVE EXAMPLE 6

Formation of Light Reflection Layer

An aluminum-deposited layer with a thickness of about 400 Å serving as a light reflection layer was formed on a polyester film with a thickness of about 50 μm.

Formation of Reversible Thermosensitive Recording Layer

The following components were mixed to prepare a coating liquid for a reversible thermosensitive recording layer. The thus obtained coating liquid was coated on the above formed light reflection layer by a wire bar and dried under application of heat thereto, so that a reversible thermosensitive recording layer having a thickness of about 5 μm was formed on the light reflection layer.

| | Parts by Weight |
|---|---|
| Behenic acid | 9 |
| Eicosanedioic acid | 1 |
| Vinyl chloride-vinyl acetate copolymer (Trademark "VYHH" made by Union Carbide Japan K.K., Tg: 72° C.) | 30 |
| Di-2-ethylhexyl phthalate | 3 |
| Tetrahydrofuran | 150 |
| Toluene | 15 |

Formation of Intermediate Layer

The following components were mixed to prepare a coating liquid for an intermediate layer. The thus obtained coating liquid was coated on the above formed reversible thermosensitive recording layer by a wire bar and dried under application of heat thereto, so that an intermediate layer having a thickness of about 0.5 μm was formed on the reversible thermosensitive recording layer.

| | Parts by Weight |
|---|---|
| Polyamide resin (Trademark "CM8000" made by Toray Industries, Inc.) | 10 |
| Ethyl alcohol | 90 |

Formation of Overcoat Layer

The same components for the overcoat layer used in Example 11 were mixed to prepare a coating liquid for an overcoat layer. The thus obtained coating liquid was coated on the above formed intermediate layer by a wire bar, dried under application of heat thereto and hardened by using an ultraviolet lamp of 80 W/cm, so that an overcoat layer having a thickness of about 2 μm was formed on the intermediate layer.

Thus, a comparative reversible thermosensitive recording material was obtained.

Using the above reversible thermosensitive recording materials according to the present invention prepared in Examples 12 to 14 and comparative reversible thermosensitive recording material prepared in Comparative Example 6, image formation and erasure was repeated ten times in the same manner as in Example 2.

Thereafter, the reflection image density of the milky white opaque image and that of the transparent background were measured by Macbeth reflection-type densitometer RD-514 each time the image formation and erasure was performed once, three times, five times and ten times without placing a black drawing paper behind the recording material.

The results in Comparative Example 6 and Examples 12 to 14 are shown in FIGS. 8 to 11, respectively.

Figure 8:
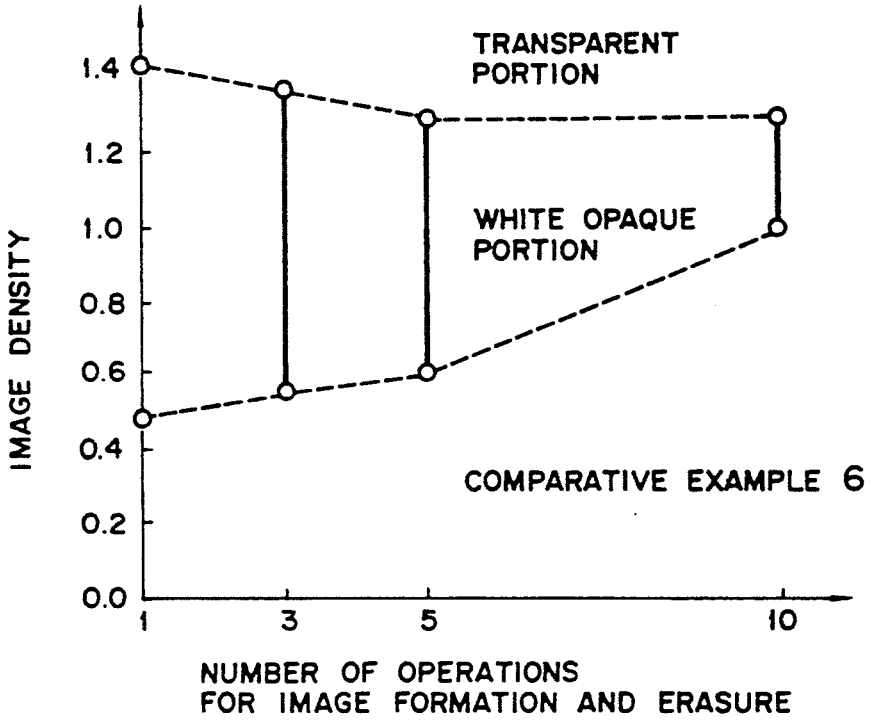
FIGS. 8 to 11 are graphs which show the relationship between the number of the operations for image formation and erasure and the density of a transparent portion and a white opaque portion in the reversible thermosensitive recording materials prepared in Comparative Example 6 and Examples 12 to 14.

As can be seen from the graph in FIG. 8, the image area hardly became opaque after the image formation and erasure was repeated ten times, so that the image contrast was lowered.

Figure 9:
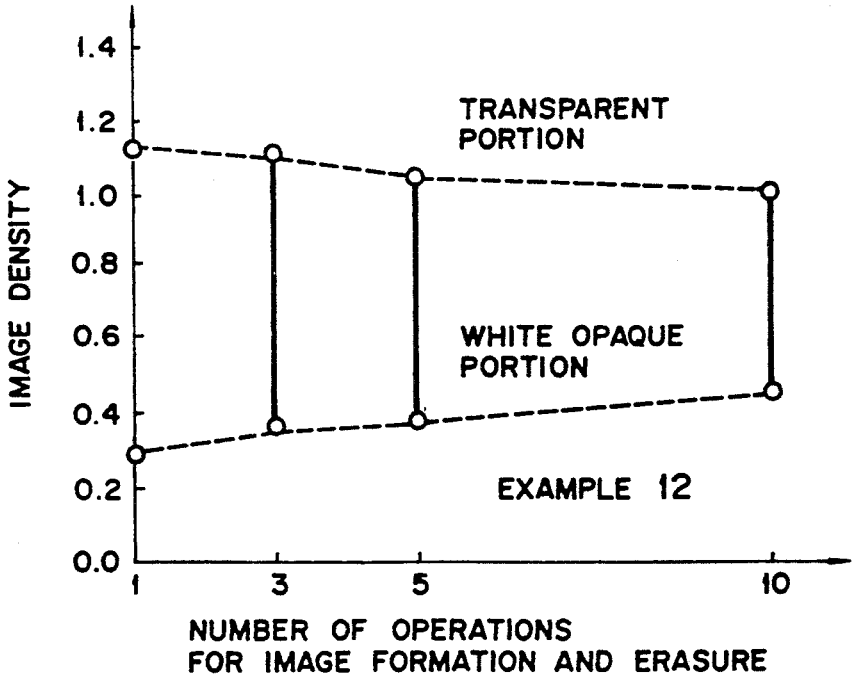
Figure 10:
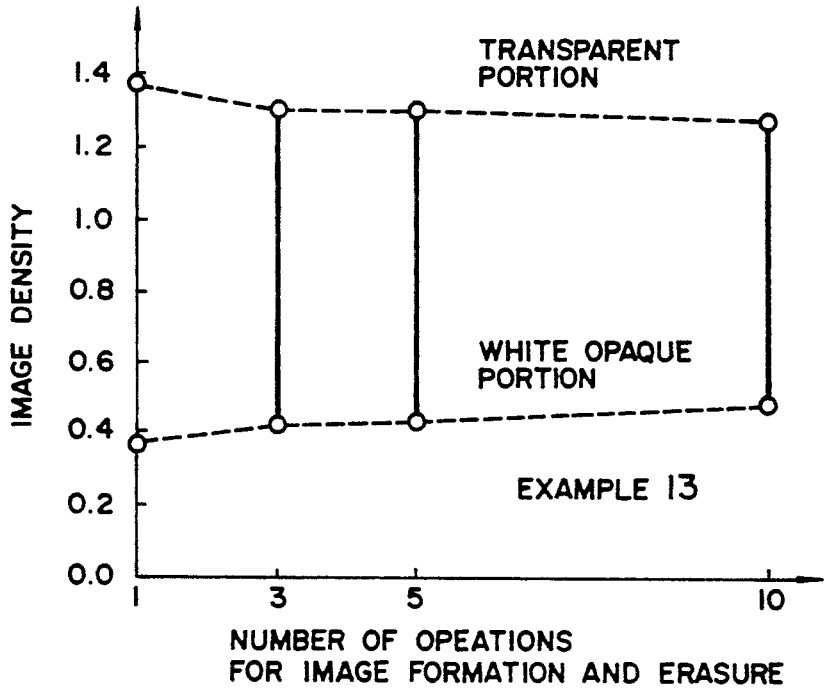
Figure 11:
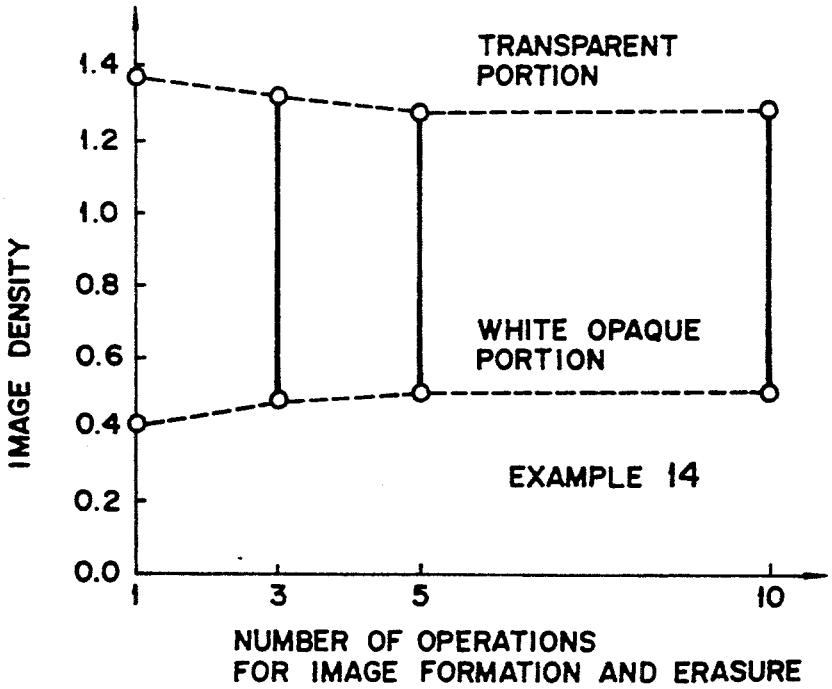

In contrast to the above, as in FIGS. 9 to 11, the reflection image density of the milky white opaque image was maintained to be low and that of the transparent background was maintained to be high, so that the image contrast was excellent after the repetition of the image formation and erasure.

As previously mentioned, the reversible thermosensitive recording materials of the present invention have the advantage that the whiteness degree of the milky white opaque portion is not degraded even if the image formation and erasure was repeatedly performed by applying the heat and pressure to the recording material at the same time. This is because the matrix resin in the reversible thermosensitive recording layer comprises a resin component with a glass transition temperature of 90° C. or more.

What is claimed is:

1. A reversible thermosensitive recording material comprising a support and a reversible thermosensitive recording layer formed on said support, said reversible thermosensitive recording layer comprising a matrix resin and an organic low-molecular-weight material dispersed in said matrix resin, and having a temperature-dependent transparency, said matrix resin comprising a resin component having a glass transition temperature of 90° C. or more.

2. The reversible thermosensitive recording material as claimed in claim 1, wherein said matrix resin further comprises a resin component having a glass transition temperature of less than 90° C.

3. The reversible thermosensitive recording material as claimed in claim 2, wherein said resin component having a glass transition temperature of less than 90° C. comprises at least one component selected from the group consisting of a vinyl chloride copolymer, vinylidene chloride copolymer and a low-heat-resistant polyester resin.

4. The reversible thermosensitive recording material as claimed in claim 3, wherein said resin component having a glass transition temperature of less than 90° C. is a vinyl chloride copolymer.

5. The reversible thermosensitive recording material as claimed in claim 4, wherein said vinyl chloride copolymer is selected from the group consisting of vinyl chloride resin, vinyl chloride - vinyl acetate copolymer, vinyl chloride - vinyl acetate - vinyl alcohol copolymer, and vinyl chloride - vinyl acetate - maleic acid copolymer.

6. The reversible thermosensitive recording material as claimed in claim 3, wherein said resin component having a glass transition temperature of less than 90° C. is a vinylidene chloride copolymer.

7. The reversible thermosensitive recording material as claimed in claim 6, wherein said vinylidene chloride copolymer is selected from the group consisting of polyvinylidene chloride, vinylidene chloride - vinyl chloride copolymer, and vinylidene chloride - acrylonitrile copolymer.

8. The reversible thermosensitive recording material as claimed in claim 3, wherein said resin component having a glass transition temperature of less than 90° C. is a low-heat-resistant polyester resin.

9. The reversible thermosensitive recording material as claimed in claim 2, wherein the ratio by weight of said resin component having a glass transition temperature of 90° C. or more is at least 1 wt.% in said matrix resin.

10. The reversible thermosensitive recording material as claimed in claim 1, wherein said resin component having a glass transition temperature of 90° C. or more comprises at least one component selected from the group consisting of chlorinated vinyl chloride resin, phenoxy resin, styrene resin, polymethyl methacrylate, polydivinyl benzene, polycarbonate, polyvinyl formal, high-heat-resistant polyester, and copolymers of said resin components.

11. The reversible thermosensitive recording material as claimed in claim 1, further comprising a light reflection layer, which s interposed between said reversible thermosensitive recording layer and said support.

12. The reversible thermosensitive recording material as claimed in claim 11, further comprising an adhesive layer between said light reflection layer and said reversible thermosensitive recording layer.

13. The reversible thermosensitive recording material as claimed in claim 1, further comprising an overcoat layer on said reversible thermosensitive recording layer.

14. The reversible thermosensitive recording material as claimed in claim 13, further comprising an intermediate layer between said overcoat layer and said reversible thermosensitive recording layer.

* * * * *

UNITED STATES PATENT AND TRADEMARK OFFICE

CERTIFICATE OF CORRECTION

PATENT NO. : 5,158,926

DATED : October 27, 1992

INVENTOR(S) : Yoshihiko HOTTA, et al.

It is certified that error appears in the above-indentified patent and that said Letters Patent is hereby corrected as shown below:

Column 1, line 44, delete "ar" and insert --are--.

Column 1, line 49, insert --.-- after "layer".

Column 3, line 23, insert --.-- before "Even".

Column 5, line 3, delete "kin of the matrix" and insert --kind of matrix--.

Column 7, line 36, delete "example" and insert --examples--.

Column 10, line 31, delete "neat" and insert --heat--.

Signed and Sealed this

Fourth Day of January, 1994

*Attest:*

Bruce Lehman

BRUCE LEHMAN

*Attesting Officer*

*Commissioner of Patents and Trademarks*